US011136163B2

(12) United States Patent
Uthuppan

(10) Patent No.: US 11,136,163 B2
(45) Date of Patent: Oct. 5, 2021

(54) FLAT TOP STORAGE DEVICE

(71) Applicant: Jose P Uthuppan, Allentown, PA (US)

(72) Inventor: Jose P Uthuppan, Allentown, PA (US)

( * ) Notice: Subject to any disclaimer, the term of this patent is extended or adjusted under 35 U.S.C. 154(b) by 0 days.

(21) Appl. No.: 16/222,972

(22) Filed: Dec. 17, 2018

(65) Prior Publication Data

US 2019/0118998 A1 Apr. 25, 2019

Related U.S. Application Data

(60) Provisional application No. 62/599,914, filed on Dec. 18, 2017, provisional application No. 62/441,677, filed on Jan. 3, 2017.

(51) Int. Cl.

| | |
|---|---|
| ***B65D 5/46*** | (2006.01) |
| ***A45C 11/20*** | (2006.01) |
| ***B65D 81/32*** | (2006.01) |
| ***B65D 1/02*** | (2006.01) |
| ***B65D 85/72*** | (2006.01) |
| ***B65D 81/38*** | (2006.01) |
| ***B65D 1/36*** | (2006.01) |
| ***B65D 21/02*** | (2006.01) |
| ***F25D 25/00*** | (2006.01) |

(52) U.S. Cl.

CPC ..... *B65D 5/46072* (2013.01); *A45C 11/20* (2013.01); *B65D 1/02* (2013.01); *B65D 1/36* (2013.01); *B65D 21/0202* (2013.01); *B65D 81/3216* (2013.01); *B65D 81/3813* (2013.01); *B65D 85/72* (2013.01); *F25D 25/00* (2013.01); *F25D 2331/803* (2013.01); *F25D 2331/805* (2013.01)

(58) Field of Classification Search

CPC ..... B65D 5/46072; B65D 81/3813; B65D 81/3216; B65D 85/72; B65D 1/36; B65D 21/0202; F25D 25/00; A45C 11/20

See application file for complete search history.

(56) References Cited

U.S. PATENT DOCUMENTS

| | | | | |
|---|---|---|---|---|
| 4,747,490 A * | 5/1988 | Smith | A45C 11/20 206/542 |
| D415,423 S * | 10/1999 | Miller | D9/431 |
| D451,281 S * | 12/2001 | Wodkowski | D3/307 |
| 8,636,169 B2 * | 1/2014 | Sampaio | B65D 25/2891 200/555 |
| D876,835 S * | 3/2020 | Libman | D3/310 |

(Continued)

*Primary Examiner* — Don M Anderson

(57) ABSTRACT

A storage device (organizer) with a unique flat top lifting handle and having separate storage regions designed to accommodate common sandwich ingredients. Having a flat surface lifting handle enables other items to be placed on that surface thus saving space. The preferred embodiment of the invention has a middle compartment to hold bottles with an end compartment on either end—the walls of which also provide support for the bottles. One of the end compartments has a lid to ensure proper humidified environment to keep greens fresh and the other can accommodate a knife and a tray for extra storage. The middle compartment also has a single removable socket to fit two pump bottles for condiments.

The device is intended for everyday use in a refrigerator and for easy transfer to a cooler. However, being a storage device, its use is not limited to food products or inside a refrigerator and maybe used outside the refrigerator as well wherever space saving is desired.

3 Claims, 5 Drawing Sheets

(56) References Cited

U.S. PATENT DOCUMENTS

| | | | | |
|---|---|---|---|---|
| 2005/0109776 | A1* | 5/2005 | Camp, Jr. | A45C 11/20 220/23.86 |
| 2008/0083753 | A1* | 4/2008 | Escobar | A47B 88/994 220/8 |
| 2010/0133132 | A1* | 6/2010 | Allan | B25H 3/02 206/372 |
| 2016/0153690 | A1* | 6/2016 | Patsis | B62B 1/125 222/608 |

* cited by examiner

FLAT TOP STORAGE DEVICE

CROSS REFERENCES TO RELATED APPLICATION

The present application claims priority to provisional patent application No. 62/599,914 filed on Dec. 18, 2017 and titled 'FLAT TOP STORAGE DEVICE (Sandwich Preparation Organizer)' the entire contents of the above-referenced patent application is incorporated by reference herein.

The present application also claims priority to provisional patent application No. 62/441,677 filed on Jan. 3, 2017 and titled 'FLAT TOP STORAGE DEVICE (Sandwich Caddy)'.

BACKGROUND

There are shower caddies, cleaning supplies caddies, tool organizers, medicine caddies, lawn mower caddies, bedside caddies, jewelry containers, art supplies caddies, school supplies caddies, lunch boxes and the like that are in everyday use and that hold a patent. Similarly, numerous patented food storage containers of all shapes and sizes exist. But all such containers—if they have anything to do with sandwiches—are designed for easy 'transportation of a finished sandwich' and not focused on the 'sandwich making process' itself. None of these storage devices (or organizers) address the inconveniences associated with locating the sandwich ingredients from different sections of a refrigerator and at the same time also attempt to simplify the sandwich making process by careful attention to its design.

The usual sandwich ingredients such as lunch meat & cheese, lettuce, tomato, onions, pepper, and various sauce bottles could be sitting at multiple locations in a refrigerator. To make a sandwich with more than two ingredients, one usually has to keep the fridge door open for a long time, open/close the crisper, and/or open the fridge door more than once until all items are found. As is often the case with more than one person using the same fridge, the bottles could keep moving around on the shelves. Ingredients like lettuce could be in a plastic wrap inside the crisper. If one uses a flat top plastic container to store them (such as U.S. Pat. No. 9,108,766 issued on Aug. 18, 2015 to Gosen et al), it is simply not designed to hold condiment bottles nor is it designed with emphasis on sandwich preparation. Besides, mayonnaise in a bottle may need a butter knife to be spread as the plastic container was not designed with pump bottles in its configuration (assuming such a container could accommodate a mayonnaise or mustard bottle). Lacking a handle, a plastic container cannot be grabbed easily by the lids. Such a container is also not meant to store greens, bottles, and knives together within the same space without possible damage to the soft greens as would occur when they mash against the hard bottle surface or knives during handling. Also, closed plastic containers do not offer access to items while sitting on the fridge shelves.

Now, if we look to another broad category of storage container such as U.S. Pat. No. 3,335,905 issued on Aug 15, 1967 to Arneson or to U.S. Pat. No. 7,290,651 issued on Nov 6, 2007 to Irwin et al, or to U.S. application Ser. No. 10/721,529 filed by Huff et al on Nov. 25, 2003, they can all hold condiment bottles but with the handle sticking out, none of them are space saving designs and lacking a closed compartment or provision to hold pump bottles or a knife, they do very little to help with the sandwich making process. It can be argued that a slicing knife (required to cut sandwich ingredients such as onions and tomatoes) could be stuck into the compartments but it could potentially cause injury during handling as the sharp edge has potential of being exposed if one is not careful.

Therefore, a need exists for a compact device to store all key sandwich ingredients together for everyday use in a refrigerator that addresses 'all' of the above issues. Apart from this, there is also a need make 'fresh' and 'delicious' sandwiches (with more than two ingredients) outdoors efficiently. It is the object of this novel device to help make sandwich making a 'quick' chore as it is meant to be. Such a device should be easily transferrable from a refrigerator to a cooler and out to a picnic table and then back into to the refrigerator just as easily. Such a device should also remain compact enough to fit on the typical fridge shelf, the fridge door, or a medium or smaller size cooler and be able to provide additional storage when placed on a cramped top shelf with free space above it.

BRIEF SUMMARY OF THE INVENTION

The present invention is a novel carrying device with a handle with a flat top surface that can be used inside or outside a refrigerator for food products or for non-food products. In its preferred embodiment, it could be used to 'store all key sandwich ingredients in one place' inside a refrigerator. Elements of the design in its preferred embodiment lend themselves well to making the sandwich creation process more convenient by possessing an enclosed herb compartment that retains moisture, by utilizing pre-configured pump bottles for sauces and oils, by having a provision to store a slicing/bread knife, and by having space set aside for storing partially cut pieces of food for re-use (or extra storage space). The flat top surface enables the placement of other food containers on top thus saving space when the device is sitting on a cramped refrigerator shelf. The device is compact enough to fit on a typical fridge shelf, fridge door, or in a medium size or smaller cooler.

BRIEF DESCRIPTION OF THE DRAWINGS

The figures depicted show the overall design and appearance and are examples of various embodiments. Not every manufacturing detail maybe displayed here.

DETAILED DESCRIPTION OF THE INVENTION

In the ensuing description of the invention, numerous details concerning the possible ways in which the device could be used are laid out with emphasis on storing sandwich ingredients. They are intended to provide a thorough understanding of its versatility and by no means limit the scope of the invention. It will be evident to one skilled in the art that the invention can be used in ways that do not include all of those details.

Figure 1:
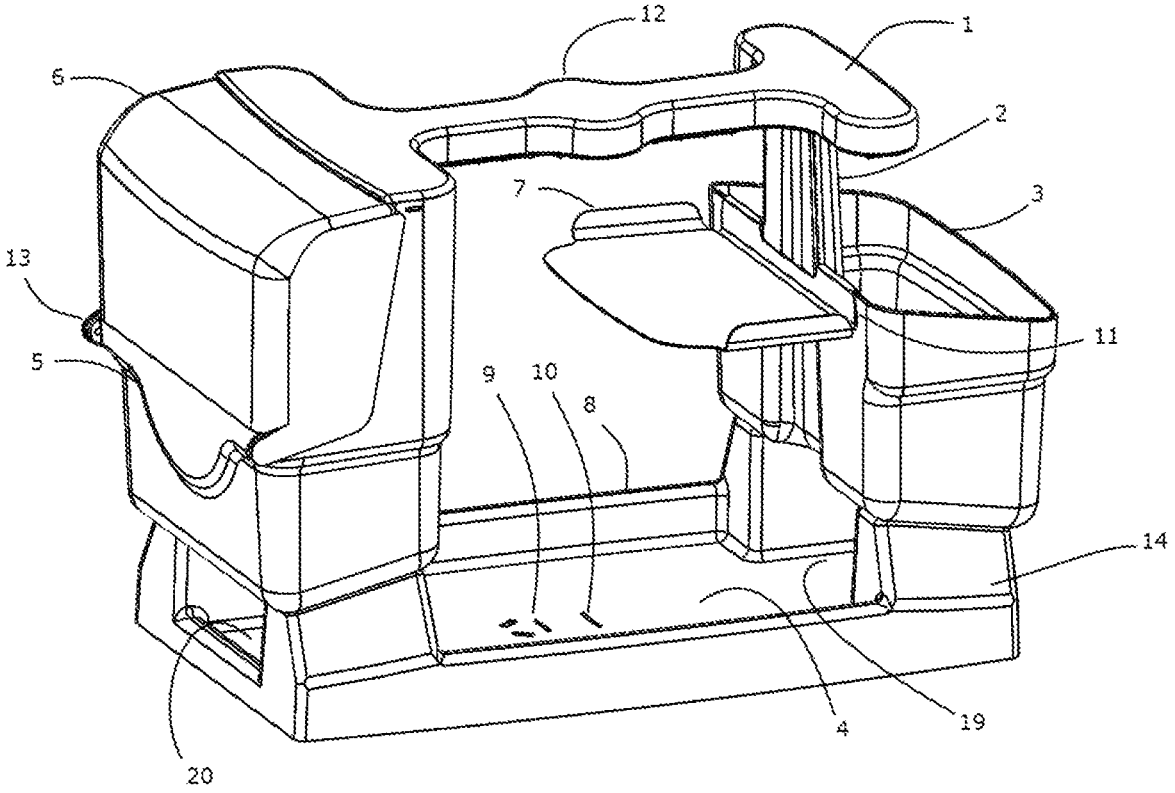
FIG. 1 depicts an isometric view of the device showing its key elements and the various regions for storage.

The invention will now be described with reference to the appending figures. FIG. 1 shows the device with the following key elements—a frame comprising a flat top handle 1, a vertical post 2, storage compartments 3 and 5 at each end, storage region 4 at the bottom, and a removable tray 7 shown in its raised position. The frame could be molded from plastic such as High Density Polyethylene (HDPE) or Polypropylene (PP) but not limited to those materials. Other possible materials could be wood, any polymer used for manufacturing common household goods, metal alloys, rigid foam or any such material that has equivalent strength. The frame members will need to have a solid core if made of wood or foam to provide the necessary strength. The top surface is supported by the vertical post 2 on one end and by the walls of storage compartment 5 on the other end. A single vertical post as shown and located towards the middle and on the inner wall of compartment 3 and not the outer wall permits easy access to items placed inside the compartment. It is to be noted that the vertical post also serves as part of the wall for compartment 3.

Figure 2:
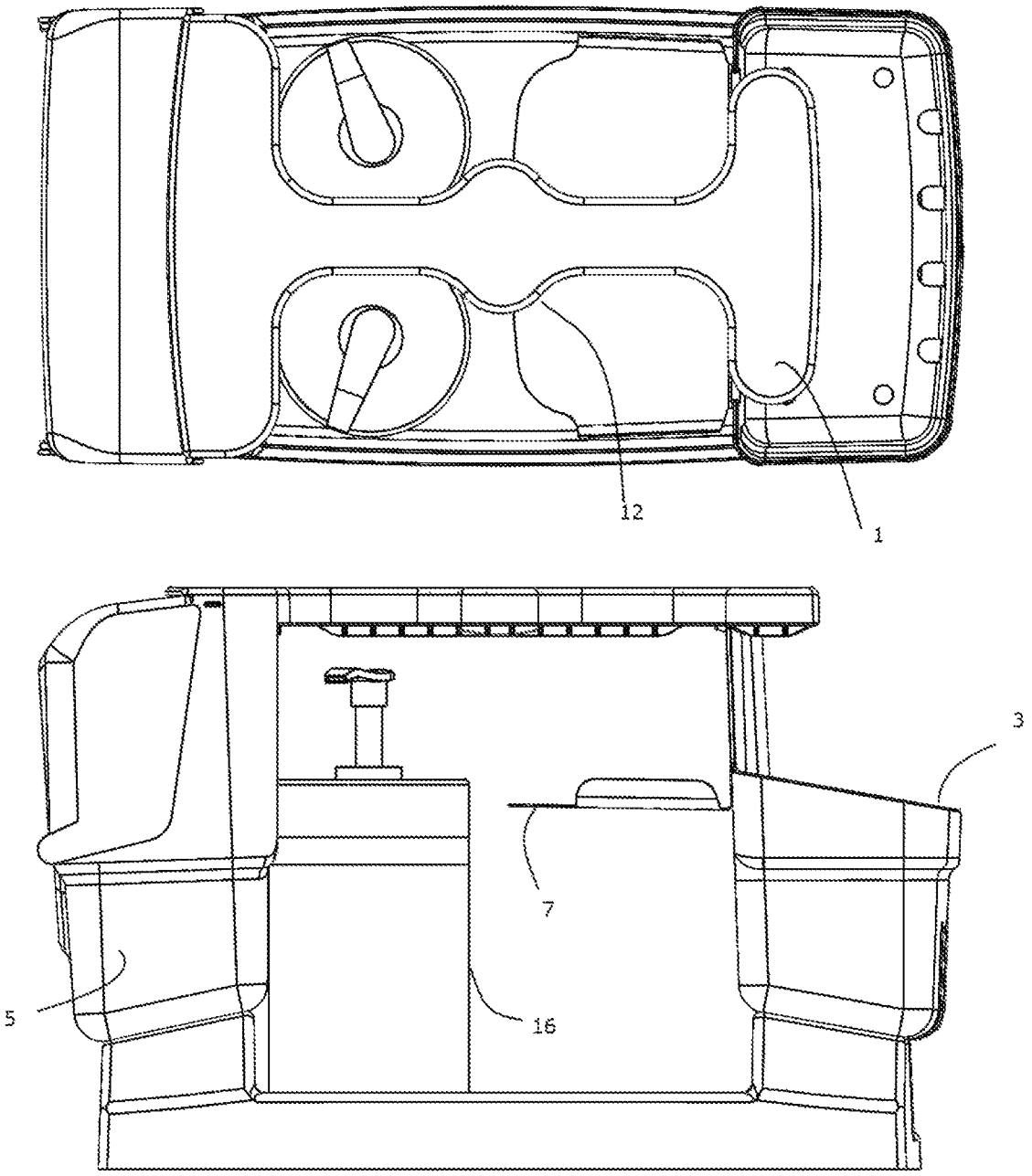
FIG. 2 shows a top view and an elevation that better illustrates the flat-top handle. It also shows the pump bottles in the preferred embodiment.

FIG. 2 shows a top view and an elevation of the preferred embodiment with two pump bottles 16 added. The flat top profile of frame as shown in the top view is designed such that it functions as a carry handle for the device to be grabbed easily and yet offering a flat surface of sufficient area to support other objects placed on it while inside a refrigerator or a cooler and still providing easy access to the contents below. The handle profile shown has an enlarged area 12 in the center region which when combined with the elongated sections at each end provide a stable surface for placement of other food containers. It should be noted that this center region is designed to be large enough for support and yet made not too large such that it would restrict easy access to the bottles when reaching from above. The handle has chamfered bottom edges to facilitate access to the storage region 4. It should be understood that the product is not limited by the profile shown here and the elements described above dictate its form. The flat top handle that doubles as a storage surface for items to be placed on it remains a unique feature of the device. The pre-configured pump bottles are designed to remain below the plane of the flat top surface. One may place condiment bottles that are taller in the same space at the expense of losing some storage for items placed on the handle.

Storage compartments 3 or 5 could be used for storing wrapped sliced meat or cheese, sweet pepper, a full tomato, onion, avocado and such. These compartments maybe formed by molded-in-plastic (of the same material as the frame) as in FIG. 1 or made of a different material than the frame and then secured with fasteners to the rest of the frame. Slots are provided for aeration and aesthetics and the design is not limited to those profiles and may appear without any cutouts as well. The elevated placement of the storage compartment 3 ensures that food placed in it—if they are not greens—do not get soggy from melted ice after long periods in the cooler when water collects at the bottom.

Figure 3:
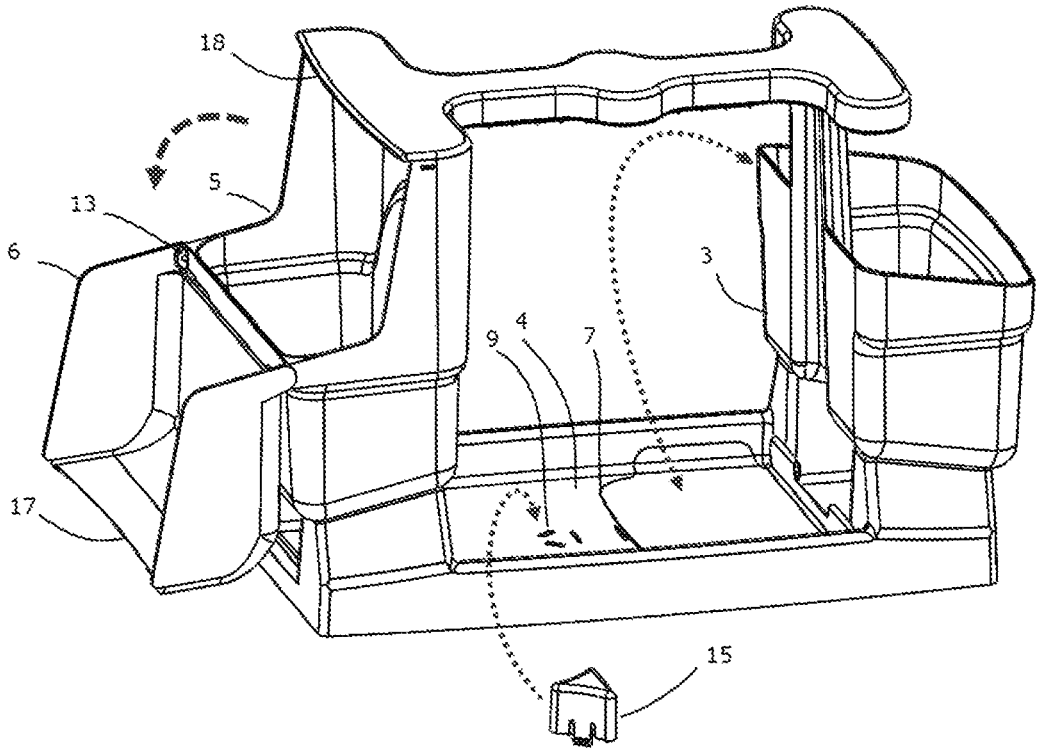
FIG. 3 is a configuration that shows the lid in the open position along with the tray sitting at the bottom instead of being elevated. It also shows the location where the pump-bottle socket snaps into the base of the device.

FIG. 3 shows the storage compartment 5 (Herb Compartment) with its lid in the open position. Shown here is a hinged lid 6 with the pivoting axis at the bottom and with a hinge 13 on each side. The lid could be made to pivot at the top or the sides or even made to operate in a sliding or snap-on manner. The lid could be made of any suitable plastic that is clear, translucent, or solid in appearance. This compartment could be used for storing leafy vegetables such as all kinds of lettuce for sandwiches or for herbs such as basil or cilantro for quick access in a refrigerator. As commonly practiced, the vegetables need to be wrapped in wet paper towels to keep them fresh for the maximum amount of time. This device with its integrated Herb Compartment 5 offers both storage and easy access as well inside a refrigerator. The enclosed compartment greatly restricts air circulation around the leafy greens thus retaining the moisture for longer periods just as a crisper drawer functions in a refrigerator. Suitable openings to the compartment are provided for limited air circulation. The large radius provided on the inside edges of both storage compartments ensure easy retrieval of items. The lid has a slightly tapered profile on edge 17 to ensure easy slide fit into the underside of the flat top handle edge 18. The absence of any extra locking feature for the lid combined with the precise placement of its Center of Gravity ensuring it will fall freely towards the handle and not away when opened slightly and then released—remains a unique feature of this Herb Compartment. On the two sides of the lid, the extended sidewalls go over the storage compartment 5. The lid may also be configured with a snap fit arrangement with a latch and lock.

Figure 4:
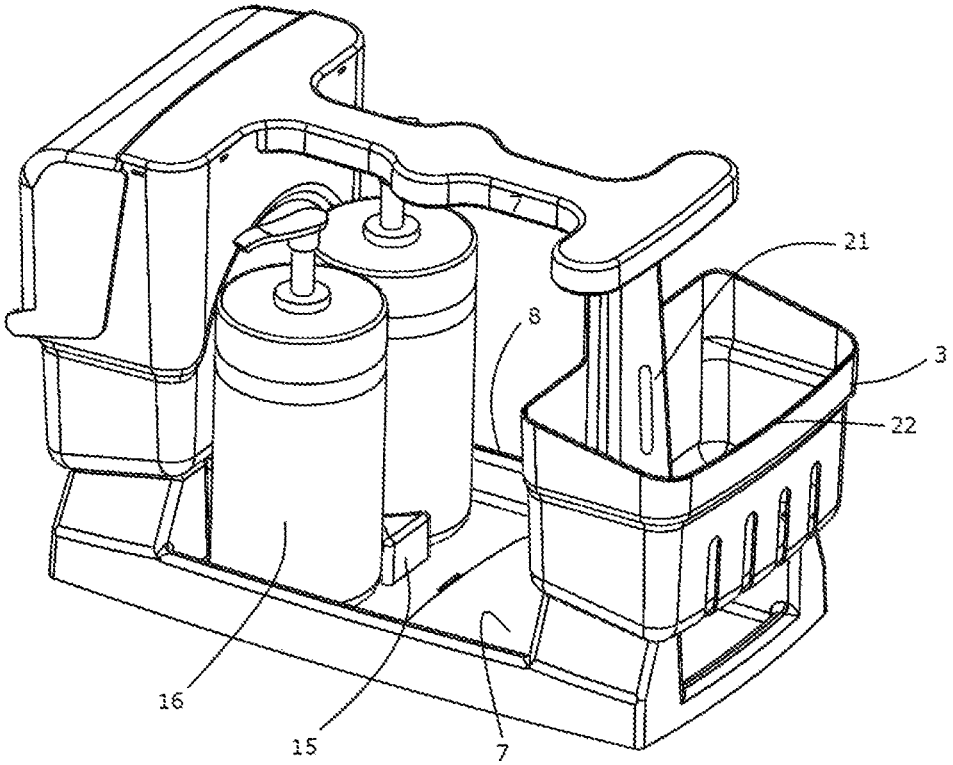
FIG. 4 depicts the preferred embodiment with the pump bottles in their sockets and the tray at the bottom along with the knife storage slot.
Figure 5:
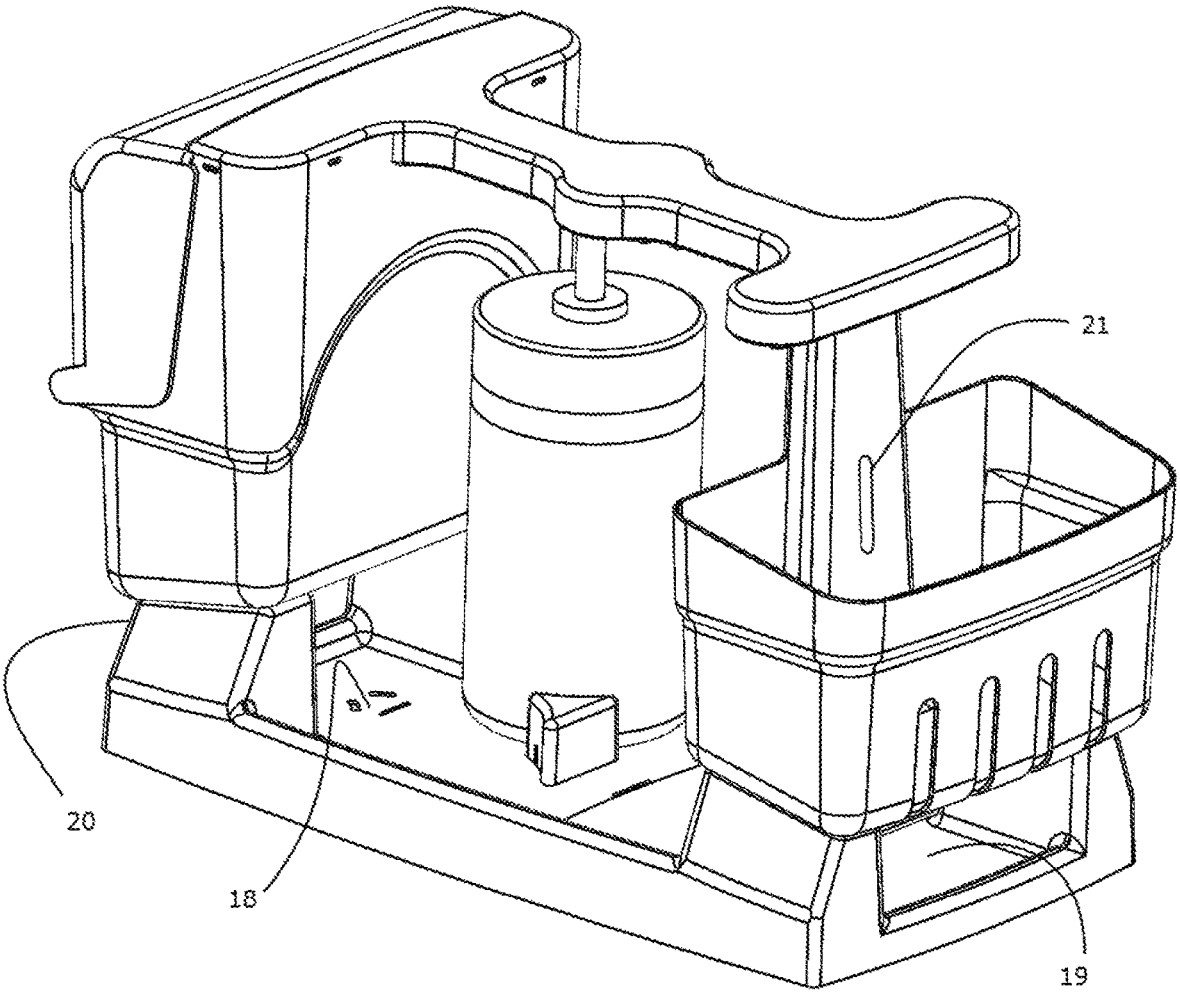
FIG. 5 shows the alternate location for the Pump Bottle Socket (when pump bottles are not used)

Storage region 4 (see FIG. 3) also forms the base of the device and can be configured for use in more than one way. The side edges 8 are raised sufficiently to act as a ledge to keep items from falling off. FIG. 3 shows slots 9 that can be used to snap-fit a socket 15 meant for two pump bottles 16 as shown in FIG. 4. Ingredients such as mayonnaise, ketchup, mustard, or oil could all be stored in pump bottles for easy dispensing directly on to bread. Largemouth pump bottles as shown are designed for easy filling of ingredients into the bottle. The pump bottle is held in place by the socket on one side, the ledge 8, and the wall of the end compartment 5. The same socket serves to keep both pump bottles in place. When the pump bottles are not used, the socket can remain on the device by snapping into slots 18 (see FIG. 5) that are away from the main storage area and this method of the socket to hold more than one bottle in place and to remain securely on the device away from its normal location when not used—is a unique feature of the device. The device may also have more than one socket to keep more such pump bottles in place.

When pump bottles are not used, the entire region 4 (see FIG. 1) can be used to place any commercially available condiment bottles that are locked in by the end compartment walls on either end and by the ledge 8 on the sides. The region below the end compartments could be used for storage of ingredients used in small quantities such as spices.

FIG. 4 shows the slot 21 used for storing a slicing knife or bread knife on board the device. The knife (not shown) could be inserted through the slot and the handle made to rest on the edge 22 of compartment 3. When inserted into the slot, only the handle portion of a slicing knife would be exposed inside compartment 3. The bottom of the slot 21 is located sufficiently low that the knife would rest at an angle with tip towards the bottom or the storage area 4 (see FIG. 3). Any sharp edge on the knife would further be shielded by the condiment bottles on the sides (not shown) and the inside wall of compartment 3. This is a safe way to store the knife with the sharp edge tucked in the middle region and not on the perimeter. FIG. 4 also shows the preferred embodiment with the pump bottles in place and the removable tray 7 shown here in the bottom position. The tray in the elevated position (shown in FIGS. 1 & 2) could be used for keeping partially cut pieces of tomato, onion, avocado etc. covered in plastic wrap. The extra storage below then could be used for small bottles of pesto or other such items. The tray configuration has a few unique features. The sheet metal version of the tray shown here has a raised rear edge with a hem that fits snugly into the top edge of storage compartment 3 (see FIG. 1). The frame post 2 locks it and keeps it from moving sideways. It is also designed with a slight angle (see FIG. 2 elevation) so that items placed on it will not fall off easily. In the event that for a period of time the user wants to discontinue the use of the tray for whatever reason, it can be lifted and placed at the base (see FIG. 3) thereby keeping it together with the device and not hindering the operation of the device in any manner. If the user prefers to use the entire base region 4 to store condiment bottles of different sizes only, then this arrangement of 'tray at the bottom' is desirable. This tray can also be of a different form (made of molded plastic with raised edges all around) with a similar but molded-in hook at the back to lock into the end compartment edge.

The invention claimed is:

1. A storage organizer wherein the organizer comprises: a carry handle with a first elongated end and a second elongated end, a bottom shelf configured to hold bottles, a first compartment that attaches the first elongated end of the carry handle at a topside of the storage organizer to a first end of the bottom shelf directly below the carry handle, and a second compartment that attaches the second elongated end of the carry handle at the topside of the organizer to a second end of the bottom shelf directly below the carry handle, thereby providing support for the bottles placed between the first and second compartments when being held, wherein;

a) the carry handle has a flat surface on a top side that includes an enlarged middle portion configured to provide support for items placed on the carry handle;

b) at least one of the first and second compartments has openings configured to let air in and is covered by a removable lid that can be opened and closed to maintain a humidified environment inside the at least one of the first and second compartments;

c) a slot configured to carry a bread knife or a slicing knife is provided on board the storage organizer such that a sharp edge of the bread knife or the slicing knife is protected by the first and second compartments.

2. The storage organizer of claim 1, comprising; a storage tray with a hem disposed on an end of the storage tray, and the storage tray is configured to be removably attached to at least one of the first compartment or the second compartment.

3. The storage organizer of claim 1, comprising; a socket holder configured to hold pump bottles on the bottom shelf, wherein;

the socket holder has snap clips that snap into a first set of slots on the bottom shelf when the pump bottles are in use, and the storage organizer having a second set of slots for storage of the socket holder on the storage organizer when the pump bottles are not in use.

* * * * *